US007753736B2

(12) United States Patent
Yang et al.

(10) Patent No.: US 7,753,736 B2
(45) Date of Patent: Jul. 13, 2010

(54) ELECTRICAL CONNECTOR CONFITURED BY UPPER AND LOWER UNITS

(75) Inventors: Sheng-Ho Yang, Tu-Cheng (TW); Chun-Chieh Yang, Tu-Cheng (TW); Tsu-Yang Wu, Tu-Cheng (TW); Hsin-Kai Huang, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/570,141

(22) Filed: Sep. 30, 2009

(65) Prior Publication Data

US 2010/0081333 A1 Apr. 1, 2010

(30) Foreign Application Priority Data

Sep. 30, 2008 (TW) ..... 97217531 U

(51) Int. Cl.
*H01R 25/00* (2006.01)
*H01R 27/02* (2006.01)
*H01R 31/00* (2006.01)
*H01R 33/00* (2006.01)

(52) U.S. Cl. ..... 439/638; 439/79; 439/83

(58) Field of Classification Search ..... 439/79, 439/638, 80, 81, 83, 82, 751
See application file for complete search history.

(56) References Cited

U.S. PATENT DOCUMENTS 7,033,218 B2 * 4/2006 Huang et al. ..... 439/607.04
7,497,739 B2 * 3/2009 Zhang et al. ..... 439/638

FOREIGN PATENT DOCUMENTS

TW M271277 7/2005

* cited by examiner

*Primary Examiner*—Javaid Nasri
(74) *Attorney, Agent, or Firm*—Wei Te Chung; Andrew C. Cheng; Ming Chieh Chang

(57) ABSTRACT

An electrical connector assembly includes an upper insulative base and a lower insulative base discrete from each other, and assembled therewith along an up-to-down direction instead of a left-to-right direction. Thus, a small assembly space will be achieved compared to the prior art.

3 Claims, 6 Drawing Sheets

ELECTRICAL CONNECTOR CONFITURED BY UPPER AND LOWER UNITS

BACKGROUND OF THE INVENTION

1. Field of the Invention

The present invention relates to an electrical connector, and more particularly to an electrical connector configured by upper and lower units each mated with an electronic component and a printed circuit board respectively.

2. Description of the Prior Art

Taiwanese Utility Patent No. M271277 issued LIN SHU-SUEI on Jul. 21, 2005, discloses an electrical connector for mounting on a printed circuit board. The electrical connector comprises an insulative housing, a plurality of terminals disposed therein and a pair of locking elements locking the electrical connector with the circuit board. Each terminal comprises a planar retention portion, an extending portion and a soldering portion extend from two opposite ends of the retention portion. The soldering portion has a soldering tail soldering onto a printed circuit board. The insulative housing includes a mating section and a pair of base section defined on two ends thereof. When assembling, the electrical connector is mounted onto the printed circuit board through a lateral movement of the connector relative to the printed circuit board with a long lateral distance and then assembles with a complementary electrical connector of the printed circuit board. Thus, an additional space induced for the lateral movement of the connector relative to the printed circuit board will be requested during assembly. Nowadays, with a miniaturization trend in the connector industry, even a small real estate on the printed circuit board is precious since additional electronic components or conductive traces can be deployed.

Hence, an improved electrical connector is desired to overcome the disadvantages of the prior art.

BRIEF SUMMARY OF THE INVENTION

Therefore, an object of the present invention is to provide an electrical connector in which only a small mounting area is needed when mounted onto a printed circuit board.

To fulfill the above-mentioned object, an electrical connector comprising an upper insulative base and a lower insulative base mounted with the upper insulative base, the upper insulative base having a mating section and a pair of head section defined on the opposite sides of the mating section longitudinally, a plurality of passageways being defined in the upper and the lower insulative base, each passageway in the upper insulative base intercommunicating with the passageway in the lower insulative base correspondingly; a plurality of contact terminals and complimentary terminals received in the passageways correspondingly, the complementary terminal having an abutting end extending beyond the top face of the lower insulative base; each contact terminal having a junction end exposing to the abutting end and extending in a first direction, the abutting end abutting against the junction end resiliently and electrically.

Other objects, advantages and novel features of the invention will become more apparent from the following detailed description when taken in conjunction with the accompanying drawings.

BRIEF DESCRIPTION OF THE DRAWINGS

The foregoing summary, as well as the following detailed description of the embodiments of the present invention, will be better understood when read in conjunction with the appended drawings. For the purpose of illustrating the invention, there are shown in the drawings embodiments which are presently preferred. As should be understood, however, the invention is not limited to the precise arrangements and instrumentalities shown. In the drawings.

DETAILED DESCRIPTION OF THE PREFERRED EMBODIMENT

Reference will now be made in detail to the preferred embodiment of the present invention.

Figure 1:
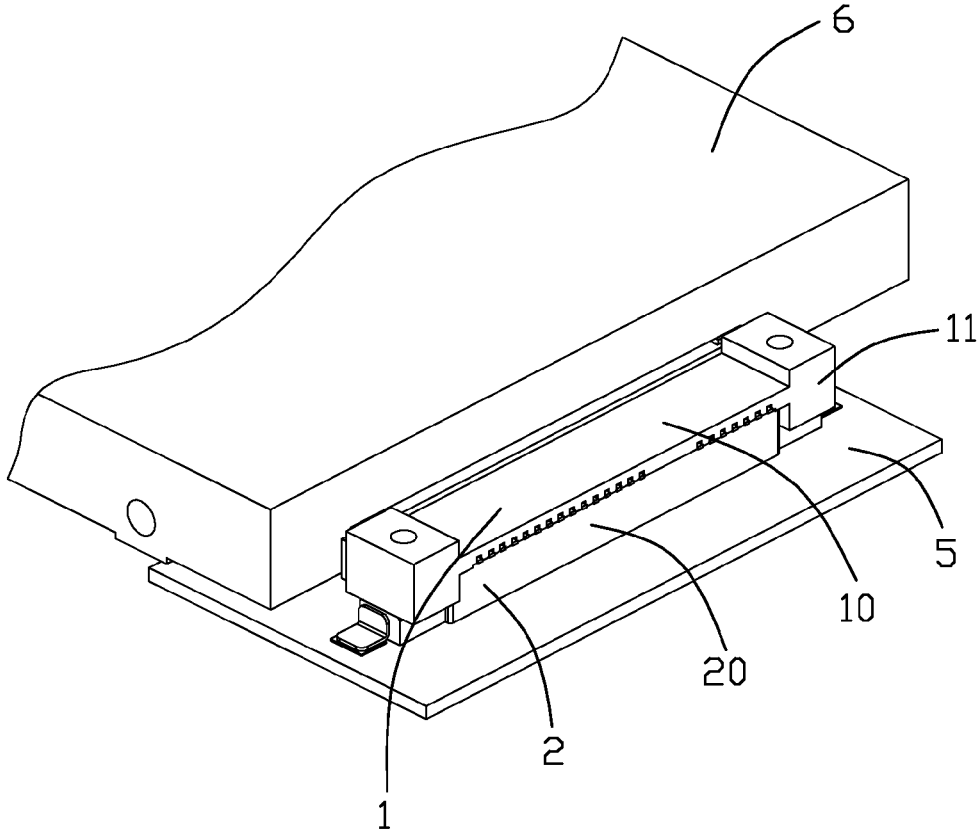
FIG. 1 is a perspective view of an electrical connector made in accordance with the present invention in which a hard disk drive shown in portion is mated thereto.
Figure 2:
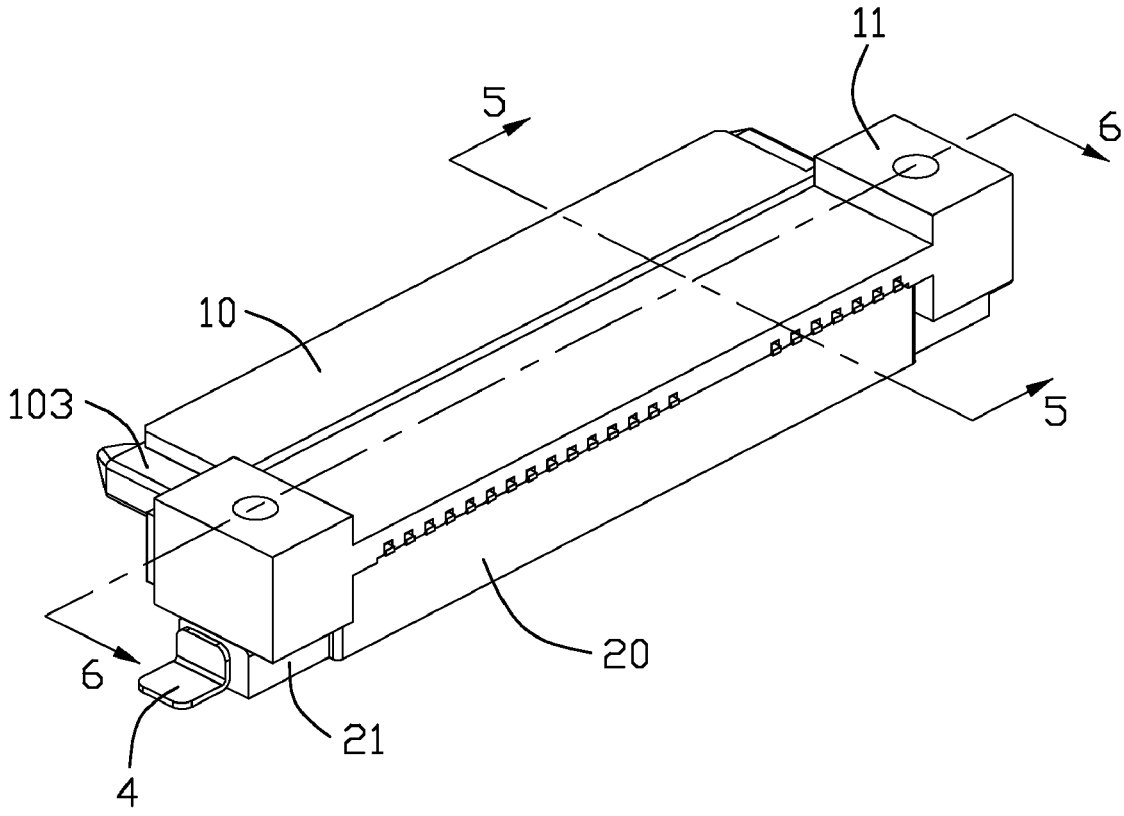
FIG. 2 is a perspective view of the connector shown in FIG. 1.
Figure 3:
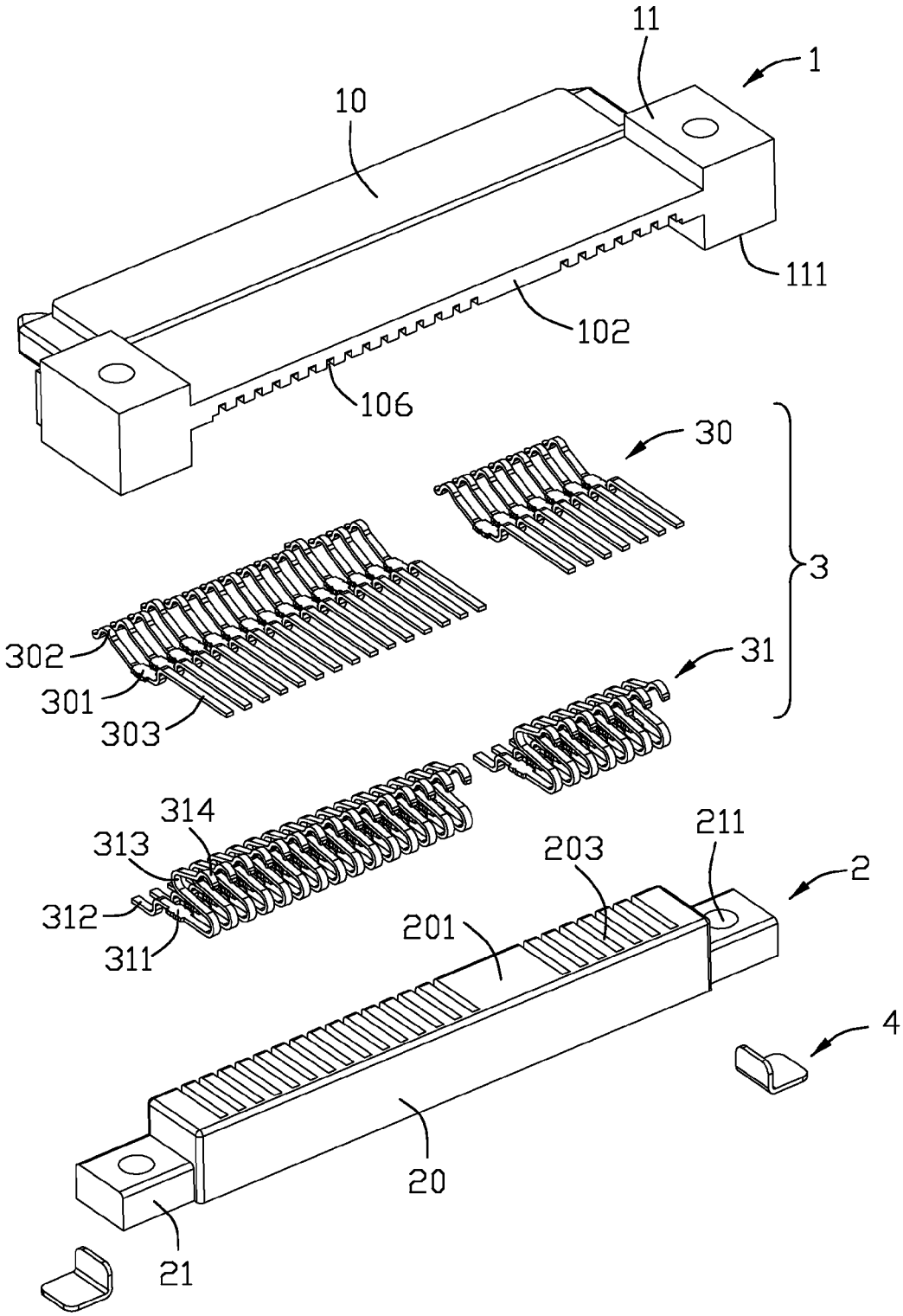
FIG. 3 is an exploded, perspective view of the electrical connector shown in FIG. 2.

Referring to FIGS. 1-3, an electrical connector according to the present invention is adapted for mounting on a circuit board 5 and connecting with a complementary connector 6 of an electronic device, such as a hard disk drive. The electrical connector comprises an upper insulative base 1 and a lower insulative base 2 located on the upper insulative base 1, a plurality of terminals 3 received in the upper insulative base 1 and the lower insulative base 2 respectively.

Referring to FIGS. 2-3, the upper insulative base 1 is substantially elongated and integrally formed, and comprises a mating section 10 and a pair of head sections 11 defined on two ends longitudinally.

Figure 4:
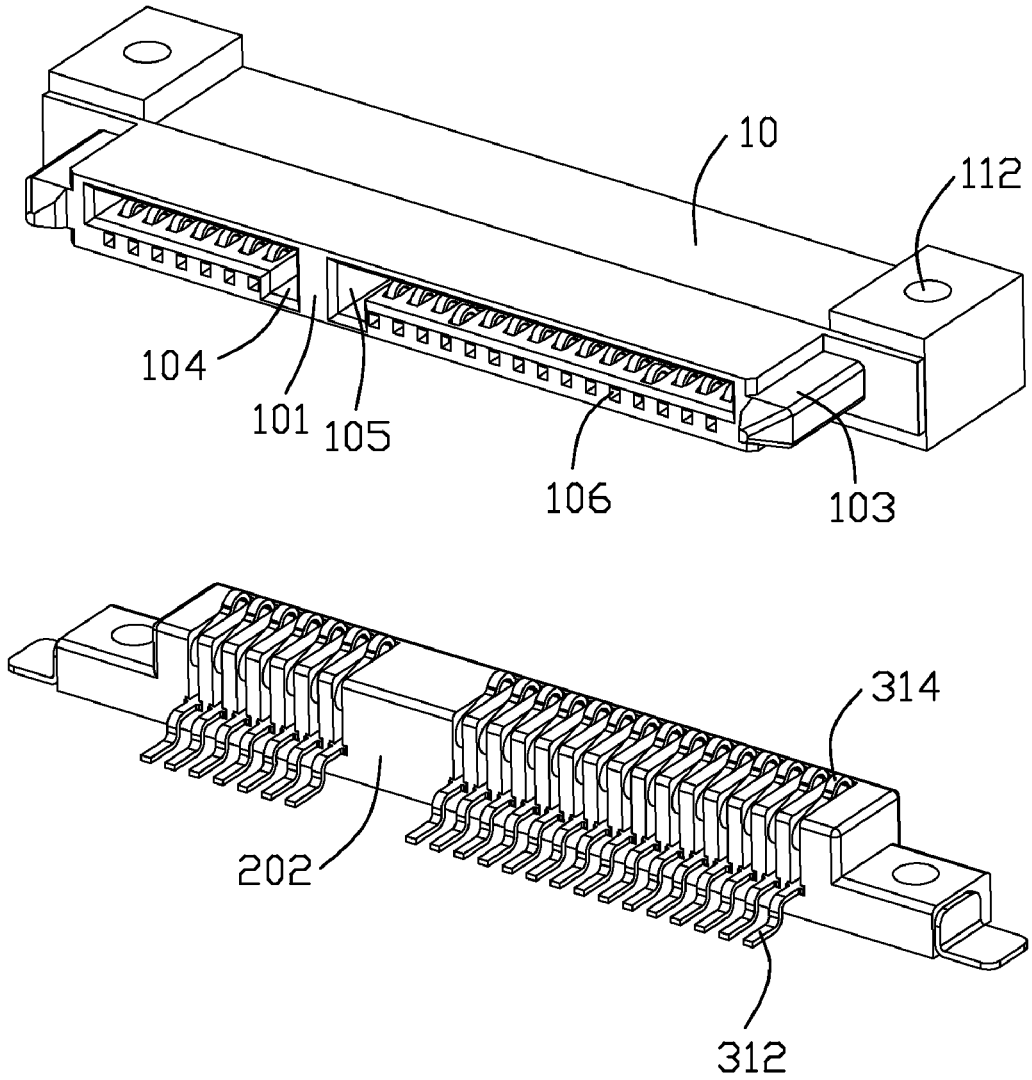
FIG. 4 is a perspective view of the connector shown in FIG. 2 in which upper and lower units are shown respectively.

Referring to FIGS. 3-4, the mating section 10 is substantially flat and elongated, and defines a longitudinal direction and a short transversal direction perpendicular to the long direction, a mating face 101 disposed at a front end of the mating section 10, an end face 102 located at a rear end of the mating section and parallel to the mating face 101 and a pair of guiding posts 103 disposed at two lateral sides thereof The mating section 10 defines a first receiving port 104 and a second receiving port 105 adjoining to the first receiving port 104. The first receiving port 104 and the second receiving port 105 respectively defines a plurality of first terminal receiving passageways 106 extending through the mating face 101 and the end face 102.

Each of head section 11 is rectangular shaped, and defines a mounting face 111 perpendicular to the end face 102 for mounting on the lower insulative base 2. A first receiving hole 112 is defined through the head section 11 from the top to down.

Referring to FIG. 3 and FIG. 4, the lower insulative base 2 is substantially elongated and integrally formed, and comprises a base section 20 and a pair of seat section 21 protruding outwardly from the base section 20 along the long direction. A second receiving hole 211 runs through each seat section 21 from the top to down correspondingly to the first receiving hole 112. The base section 20 defines a top face 201 parallel with the long direction and the short direction of mating section 10 and a front face 202 perpendicular to the top face 201. A plurality of second terminal receiving passageways 203 are defined in the base section 20 extending through the top face 201 and the front face 202.

Figure 5:
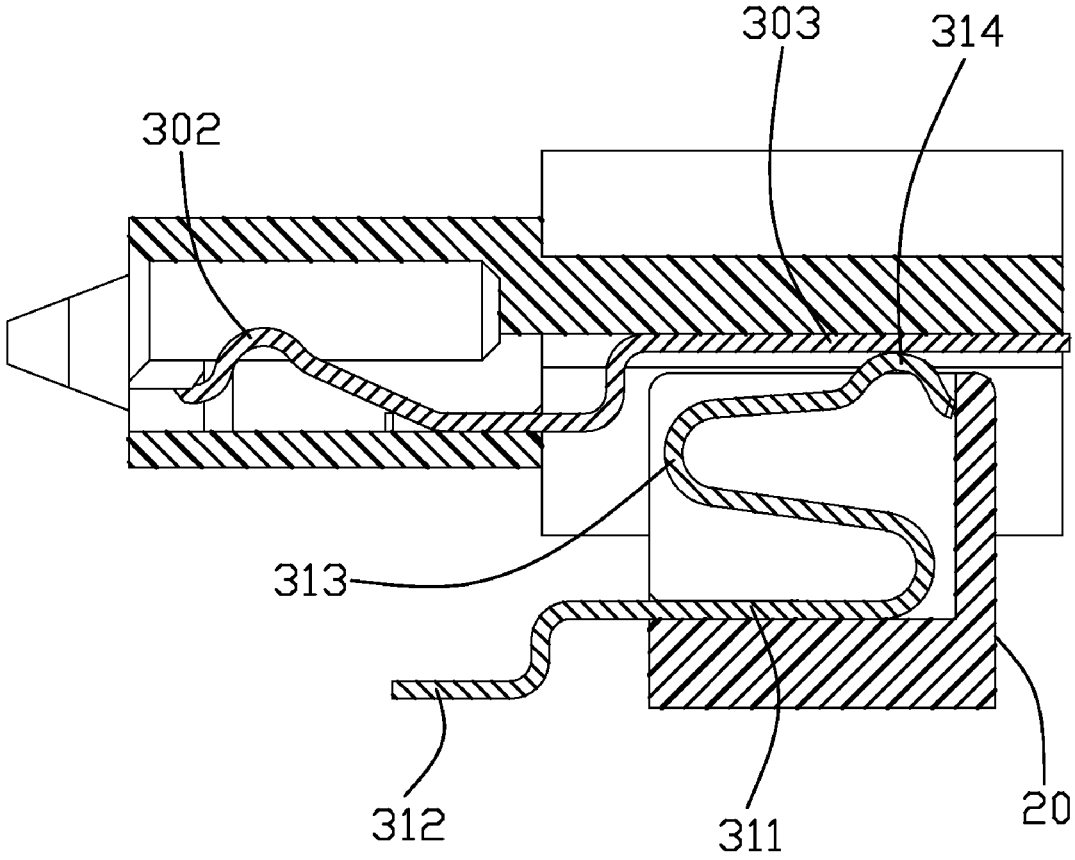
FIG. 5 is a cross sectional view of the electrical connector taken along line 5-5 of FIG. 2.
Figure 6:
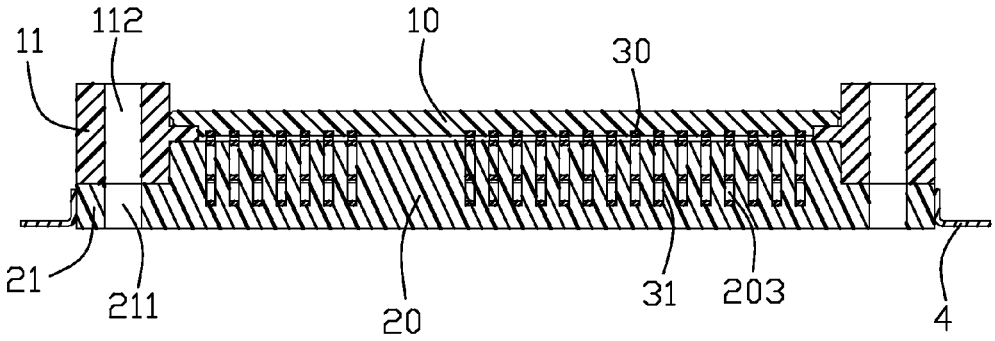
FIG. 6 is a cross sectional view of the electrical connector taken along line 6-6 of FIG. 2.

Referring to FIG. 3 and FIG. 5, the terminals 3 are divided into contact terminals 30 and complimentary terminals 31 for assembling to the first terminal receiving passageways 106 and the second terminal receiving passageways 203 respectively. Each contact terminal 30 comprises of a first retention portion 301 engaged in the first terminal receiving passageway 106. A mating end 302 and a junction end 303 extends from the two opposite ends of the first retention portion 301, the mating ends 302 are received in the first terminal receiving passageways 106 and extend into the first receiving port 104, the junction ends 303 are exposed to the complimentary terminals 31.

Each complimentary terminal 31 includes a second retention portion 311, a soldering end 312 and a resilient arm 313 extend from the two opposite ends of the second retention portion 311, the resilient arm 313 is S-shaped and defines an abutting end 314 on a free end. The abutting ends 314 extend beyond the top face 201 and abut against the junction ends 303 of the contact terminals 30 correspondingly. The soldering ends 312 extend out of the front face 202 and solder with the printed circuit board 5.

The electrical connector further comprise a pair of pads 4 assembled on the seat section 21 for positioning the electrical connector on the printed circuit board 5.

In assembling, referring to FIGS. 1-5, the contact terminals 30 are inserted into the first terminal receiving passageways 106 along the short direction from the end face 102 to the mating face 101, the complimentary terminals 31 are assembled into the second terminal receiving passageways 203 along the short direction from the front face 202 to the back face (not labeled). Afterward, the upper insulative base 1 is mounted onto the lower insulative base 2 and retains with the lower insulative base 2 in the long direction through the retention between the head section 11 and the base section 20. Meanwhile, the abutting ends 314 abut against the junction ends 303 resiliently and electrically.

Summing up the foregoing, the upper insulative base 1 and the lower insulative base 2 are assembled with a complimentary connector of the printed circuit board 5 through the terminals 3. The complimentary connector 6 can be mounted onto the printed circuit board 5 through the electrical connector in a vertical direction instead of a horizontal direction or an up-to-down direction instead of a left-to-right direction, thereby having saved an assembling space on the printed circuit board.

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising an upper insulative base and a lower insulative base mounted with the upper insulative base, the upper insulative base having a mating section and a pair of head section defined on the opposite sides of the mating section longitudinally, a plurality of passageways being defined in the upper and the lower insulative base, each passageway in the upper insulative base intercommunicating with the passageway in the lower insulative base correspondingly;

a plurality of contact terminals and complimentary terminals received in the passageways correspondingly, the complementary terminal having an abutting end extending beyond a top face of the lower insulative base;

each contact terminal having a junction end exposing to the abutting end and extending in a first direction, the abutting end abutting against the junction end resiliently and electrically; wherein the lower insulative base defines a base section and a pair of seat sections, the pair of seat sections extends from the opposite ends of the base section longitudinally; wherein the mating section and the pair of head sections defines a mating space together; wherein a hole runs through each head section and seat section correspondingly; wherein the base section retains with the mating space in a second direction after assembly.

2. An electrical connector, comprising an upper insulative base including a forwardly-protruding mating port defining an inner mating face exposed thereinto, and a back wall exposed to the exterior and downwardly facing; and a plurality of upper conductive terminals assembled to the upper insulative base, each of the upper conductive terminals having a retention portion held by the upper insulative base, a front resilient engaging section extending forwardly from the retention portion and exposed on said inner mating face, and a back stiff engaging section extending rearwardly from the retention portion and exposed on the back wall;

a lower insulative base discrete from the upper insulative base, the lower insulative base defining a region for the upper insulative base to be seated on, the lower insulative base having a top face facing to said back wall of the upper insulative base, and a side face adjacent to the top face;

and a plurality of lower conductive contacts held by the lower insulative base, each of the lower conductive contacts having a resilient contact portion exposed on said top face and adapted to engage said back engaging section of the upper insulative base, and a solder portion exposed out of the side face, wherein said resilient contact portion is connected to the solder portion by a S-shaped flexible connection portion to allow said resilient contact portion movable in an up-to-down direction relative to said solder portion; wherein a pair of head sections is defined on the longitude ends of the mating port, a mating space is defined by the pair of head sections and the mating port; wherein a pair of seat sections is defined on longitude ends of the lower insulative base with a hole defined therethrough; wherein a hole runs through each head section from top to down correspondingly to the holes defined on seat sections.

3. The electrical connector as claimed in claim 2, wherein the lower insulative base partly receives in the mating space after assembly.

* * * * *